US007380376B2

(12) United States Patent
Ohno et al.

(10) Patent No.: US 7,380,376 B2
(45) Date of Patent: Jun. 3, 2008

(54) NON-SLIP STRUCTURE

(75) Inventors: Shunji Ohno, Tokyo (JP); Norio Nakajima, Tokyo (JP); Kazumichi Iwasa, Tokyo (JP); Masanori Tsuji, Tokyo (JP); Tsuyoshi Doi, Tokyo (JP); Yoshihisa Kohzu, Tokyo (JP); Yoshihiro Agarihama, Hyogo (JP); Shinya Ura, Osaka (JP); Hideyuki Miyake, Tokyo (JP)

(73) Assignee: Shin Caterpillar Mitsubishi Ltd., Tokyo (JP)

( * ) Notice: Subject to any disclaimer, the term of this patent is extended or adjusted under 35 U.S.C. 154(b) by 198 days.

(21) Appl. No.: 10/475,258

(22) PCT Filed: Oct. 16, 2002

(86) PCT No.: PCT/JP02/10745

§ 371 (c)(1),
(2), (4) Date: Oct. 17, 2003

(87) PCT Pub. No.: WO03/033835

PCT Pub. Date: Apr. 24, 2003

(65) Prior Publication Data

US 2004/0118059 A1 Jun. 24, 2004

(30) Foreign Application Priority Data

Oct. 16, 2001 (JP) ..... 2001-318760

(51) Int. Cl.
*E04B 1/08* (2006.01)

(52) U.S. Cl. ..... 52/177; 52/179; 52/188; 428/141; 404/19

(58) Field of Classification Search ..... 52/177, 52/180, 386, 390, 179, 181, 188; 404/19, 404/21, 70; 428/141, 152, 600, 601; 119/530, 119/526; 72/325, 326, 379.2; 472/90, 88, 472/89, 91, 94
See application file for complete search history.

(56) References Cited

U.S. PATENT DOCUMENTS

| | | | | |
|---|---|---|---|---|
| 15,479 | A * | 8/1856 | Ellithorn | 404/41 |
| 768,932 | A * | 8/1904 | Davidson | 52/675 |
| 937,415 | A * | 10/1909 | Cairns | 280/169 |
| 1,441,327 | A * | 1/1923 | Blum | 52/177 |

(Continued)

FOREIGN PATENT DOCUMENTS

| | | |
|---|---|---|
| JP | 57-145037 | 9/1982 |

(Continued)

*Primary Examiner*—Phi Dieu Tran A
(74) *Attorney, Agent, or Firm*—Darby & Darby

(57) ABSTRACT

This invention relates to a non-slip structure, which is highly efficient in preventing a slip with no trouble caused by a through hole, thereby enhancing reliability.

The non-slip structure of this invention is characterized in that a portion of a metal plate such as a steel plate and the like is sheared so as to form cutting lines (a pair of lateral side cutting lines and a joining cutting line) for forming a protruded piece and, at the same time, the protruded piece is pulled up along the cutting lines to a height, which does not exceed the thickness portion of the steel plate so as to raise the shearing surface (edge), so that the sheared surface does not form a gap nor any through hole in contacting the steel plate.

9 Claims, 3 Drawing Sheets

U.S. PATENT DOCUMENTS

| | | | | | |
|---|---|---|---|---|---|
| 1,680,032 | A | * | 8/1928 | Anderson | 428/596 |
| D101,558 | S | * | 10/1936 | Rose | D25/143 |
| 2,154,597 | A | * | 4/1939 | Barrett | 428/596 |
| D140,623 | S | * | 3/1945 | Harper | D25/160 |
| D192,796 | S | * | 5/1962 | Terwilliger | D12/167 |
| 3,100,312 | A | * | 8/1963 | Williams | 15/215 |
| D198,689 | S | * | 7/1964 | Duern | D14/219 |
| 3,140,644 | A | * | 7/1964 | Lee | 52/180 |
| 3,575,764 | A | * | 4/1971 | McFarren | 156/306.6 |
| 3,627,502 | A | * | 12/1971 | Rees et al. | 428/600 |
| 4,169,339 | A | * | 10/1979 | See | 52/177 |
| 4,203,268 | A | * | 5/1980 | Gladden et al. | 52/630 |
| 4,343,119 | A | * | 8/1982 | Bahnfleth | 52/180 |
| 4,436,779 | A | * | 3/1984 | Menconi et al. | 428/169 |
| 4,596,729 | A | * | 6/1986 | Morrison | 428/44 |
| 4,620,816 | A | * | 11/1986 | Kupfer | 404/6 |
| 4,709,519 | A | * | 12/1987 | Liefer et al. | 52/98 |
| 5,653,071 | A | * | 8/1997 | Iwami et al. | 52/181 |
| 5,997,212 | A | * | 12/1999 | Takada et al. | 404/25 |
| 7,021,109 | B2 | * | 4/2006 | Ohno et al. | 72/325 |
| 7,162,839 | B2 | * | 1/2007 | Ohno et al. | 52/180 |
| 2002/0018908 | A1 | * | 2/2002 | Smith et al. | 428/600 |
| 2003/0066253 | A1 | * | 4/2003 | Lin | 52/177 |

FOREIGN PATENT DOCUMENTS

| | | | | | |
|---|---|---|---|---|---|
| JP | S57-145037 | | | 9/1982 | |
| JP | S59-77512 | A1 | | 5/1984 | |
| JP | H1-68124 | A1 | | 5/1989 | |
| JP | 4-61151 | | | 5/1992 | |
| JP | 6-101314 | | * | 4/1994 | 52/177 |
| JP | 6-185188 | | * | 7/1994 | 52/177 |
| JP | 06-322938 | A1 | | 11/1994 | |
| JP | 9-302723 | A1 | | 11/1997 | |
| JP | 2002-45928 | A1 | | 2/2002 | |
| JP | 2003-206622 | A1 | | 7/2003 | |

* cited by examiner (a)

(b)

NON-SLIP STRUCTURE

BACKGROUND OF THE INVENTION

1. Field of the Invention

The present invention relates to a non-slip structure that provides a metal plate with a non-slip protruded piece, which is highly effective in preventing a slip without any trouble caused by a through hole, thereby enhancing reliability.

2. Description of the Related Art

As non-slip structures of a metal plate which constitute floors, aisles, stairs, or decorative laminated sheets and the like of building structures, or floors and steps of buses, trucks, special vehicles and the like and, furthermore, top sides and decks of railway rolling stocks, marine vessels and the like in addition to temporary sole plates and the like of civil works and the like, heretofore, the technologies such as enumerated below have been known.

(1) A banded steel plate 11 is known, which has a non-slip banded pattern rounded and formed when a steel plate is flat-rolled (see FIG. 4(A)).

Since the height of the banded pattern 13, formed when the steel plate is flat-rolled, is low and also has a curved shape, a non-slip effect can be expected as long as it is used for a relatively good working condition. Even in such a case, not much non-slip effect can be expected (see FIGS. 4 (B) and 4(C)).

(2) A non-slip structure is known, which is laminated with a non-slip sheet comprising a sandpaper because the upper cover of construction equipment is taken as a tread.

However, this non-slip sheet is not expected to bring out satisfactory effect since the grain is crushed promptly, depending on its use.

(3) Hence, in order to eliminate these troubles, a structure is known, in which a through hole 22 having a round shape or star-like shape is first formed by punching in a steel plate 21 and, then, a large number of patterns 23 that are made by pulling up the peripheral hem of the through hole 22 by a press and the like are arranged (see FIG. 5).

In this non-slip steel plate 21, since the height of the pulled up portion of the pattern 23 can be sufficiently secured, which also becomes a sharply chopped off surface 27 by punching, much stronger non-slip effect can be expected.

Consequently, this non-slip steel plate 21 is used particularly at elevated working floors, and locations in which the non-slip effect is spoiled due to rainwater and slurries, and the like.

However, since the above-described non-slip steel plate is cut with the through hole, depending on its application, it is inevitable that there arise problems such as rainwater and slurries falling down below the tread, or fiery winds and a diffusion of noises inversely rolling up from below to the tread or the like.

Hence, this non-slip steel plate is integrally welded on a separate floor surface made of a flat steel plate or firmly fixed to it by bolting as necessary.

Since bolting makes it possible to separate the non-slip steel plate and the flat steel plate, which becomes the floor surface, it is possible to prevent a rusty fluid from arising out of rainwater accumulated between the non-slip steel plate and the flat steel plate or to clean up dusts accumulated in each non-slip pattern.

Nevertheless, in either case, since the floor structure is twofold, it leads to a rise in the manufacturing cost because of the twofold structure.

The present invention has been made in view of the above-described circumstances, and the main object of the invention is to provide a highly reliable non-slip structure, which is highly effective in preventing a slip without any trouble caused by the through hole.

A further object of the invention is to provide a non-slip structure, which is good in draining.

DISCLOSURE OF THE INVENTION

In the present invention, a cutting line to form a protruded piece is formed by shearing a portion of the metal plate and, at the same time, the protruded piece is pulled up to a height, which does not exceed the thickness of the metal plate, along the cutting line, and a sheared surface is raised along the cutting line. Since the above-described sheared surface comprises a shape which does not form the through hole in the metal plate, a non-slip effect can be realized by an edge rising high vertically, and it can be improved, compared to a conventional structure, which is low in height and rounded.

The above-described protruded piece comprises a pair of lateral side cutting lines formed at both lateral sides, and a joining cutting line, which joins between top end portions of the pair of lateral cutting lines by a straight line or a curved line. The protruded piece may have a shape, which is gradually pulled up higher from the base ends of the lateral cutting lines so that the joining cutting line become the highest in height.

Also, with a center as a horizontal surface, a plurality of protruded pieces are formed almost radially in the direction of the center around the periphery, and a pulled up edge portion of each protruded piece may be arranged in the direction of the center.

Further, when a draining path portion, which is connected to the horizontal surface of the center and is set up in the same surface, is formed between the above-described protruded pieces, an operability of cleaning works can be enhanced.

BRIEF DESCRIPTION OF THE DRAWINGS

FIG. 4(A) is a plane view thereof, FIG. 4(B) is a sectional view of a protruded piece, and FIG. 4(C) is a longitudinal sectional view thereof;

DETAILED DESCRIPTION OF THE PREFERRED EMBODIMENT

A preferred embodiment of a non-slip structure of the present invention applied to a cover plate made of steel plate which covers various units, parts and portions of frame bodies and the like of construction equipment will be described below with reference to the drawings.

Figure 1:
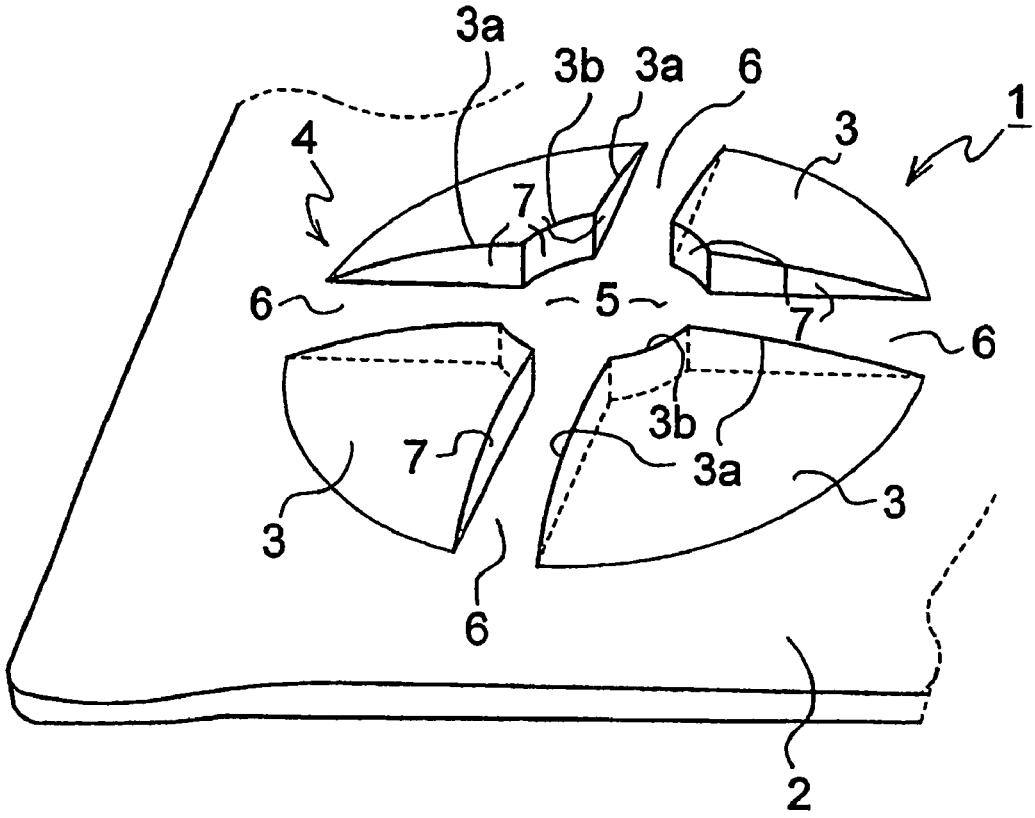
FIG. 1 is a perspective view showing one embodiment of a non-slip structure of the present invention.
Figure 2:
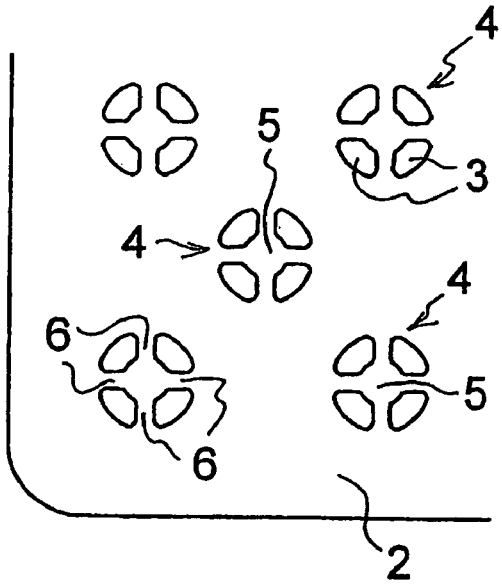
FIG. 2 is a plane view of the non-slip structure shown in FIG. 1.
Figure 3:
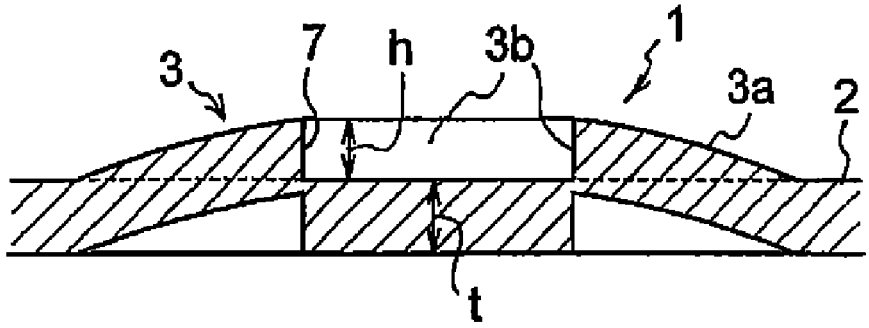
FIG. 3 is a sectional view of the non-slip structure shown in FIG. 1.
Figure 4:
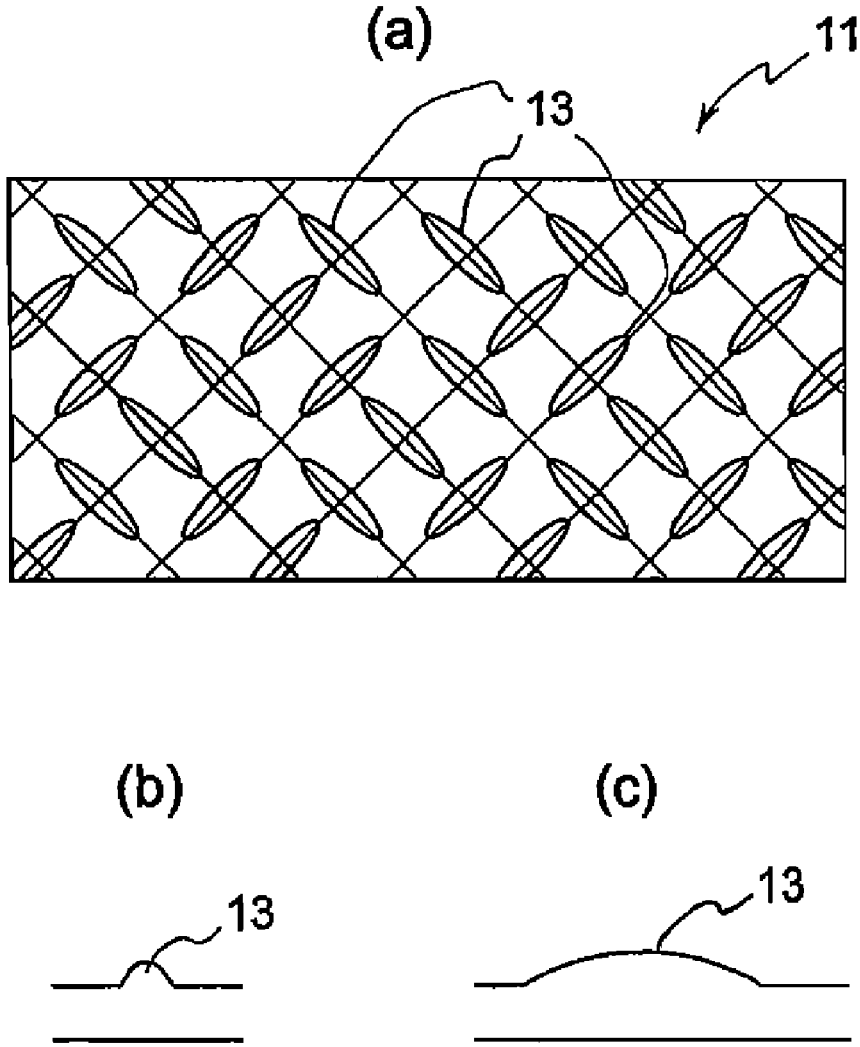
Fig. 4 PRIOR ART
FIG. 4 shows a conventional banded steel plate.
Figure 5:
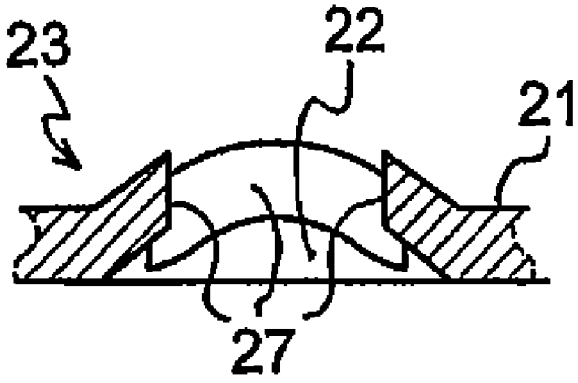
Fig. 5 PRIOR ART
FIG. 5 show the non-slip structure having a conventional through hole, FIG. 5(A) being a sectional view of the protruded piece, and FIG. 5(B), a plane view thereof.
Figure 5:
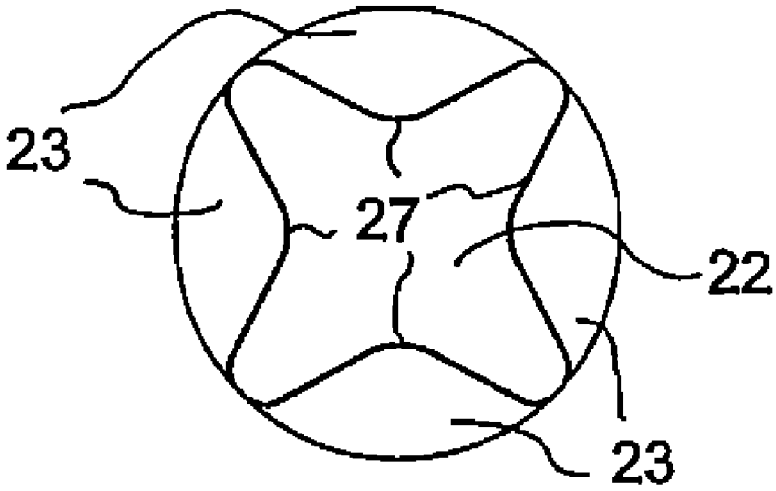
Fig. 5 PRIOR ART

This non-slip structure 1, as shown in FIG. 1 to FIG. 3, is formed on a steel plate 2 used as a cover plate of the construction equipment, and a portion of the steel plate 2 is sheared so as to form cutting lines for forming a protruded piece and, at the same time, the protruded piece is pulled up to a height (h≦t), which does not exceed a thickness (t) of the steel plate 2.

In this way, the sheared surface is raised along the cutting lines and, at the same time, the above-described sheared surface contacts the surrounding steel plate 2 at least at a part thereof and, therefore, even when a protruded piece 3 is formed, a through hole will never be formed on the steel plate 2.

That is, this protruded piece 3 has a pair of lateral side surfaces or cutting lines 3*a* formed at both lateral sides of the protruded piece 3, and an end surface or joining cutting line 3*b* which joins between the top ends of the pair of lateral cutting lines 3*a*, and has a shape which is gradually pulled up and elevated from the base end sides of the lateral cutting lines 3*b* so that the joining cutting line 3*b* becomes the highest in height.

The peripheral hem end surface (sheared surface) of the elevated protruded piece 3 becomes an edge 7, and the edge 7 along the joining cutting line 3*b* becomes the highest in height.

As described above, the portion which is divided by the lateral cutting lines 3*a* and joining cutting line 3*b* is pulled up, and becomes the protruded piece 3, which is almost fan-shaped as seen from its top view in the case of the illustrated example, and has a form which is curved spherically in its upper surface. Further, though the sheared surface along the cutting lines 3*a* and 3*b* becomes the edge 7, since it is not pulled up higher than the thickness of the steel plate 2, the lower end of the edge 7 is connected and overlapped (see FIG. 3) or brought into contact with the thickness portion of the steel plate 2 and, therefore, no gap nor any through hole is produced between the steel plate 2 and the lower end of the edge 7.

Although the protruded piece 3 may be arranged interspersedly, in the present embodiment, as shown in FIG. 1, a plurality of the protruded pieces at equal intervals with a center portion as the center (four pieces at intervals of 90 degree in the case of the illustrated example) are arranged radially so as to form one piece of a non-slip pattern 4.

The non-slip pattern 4 is arranged in plurality by an adequate configuration on a steel plate 3, which becomes a floor surface or a tread (see FIG. 2).

This non-slip pattern 4 comprises a plurality of protruded pieces 3, which are arranged in the radial pattern with an any one point as the center; a center portion 5, which is arranged in the center among these protruded pieces 3 and comprises an almost horizontal surface of the same level as a reference surface of the steel plate 2; and a draining path portion 6, which junctions this center portion 5 and comprises the almost horizontal surface which extends to cross between the adjacent protruded pieces 3.

Note that the joining cutting line 3*b* of each protruded piece 3 provided in the non-slip pattern 4 becomes a circular-arc curbed line overlapping with a concentric circle of the center portion 5.

Here, the above-described center portion 5 and the draining path portion 6 are areas left without being subjected to any process when the steel plate 2 is processed to form the protruded piece 3. In the case of the illustrated example, the center portion 5 is formed almost in a circular shape, and the draining path portion 6 is like a belt having uniform the same width and is formed so as to intersect the above-described center portion 5 at right angles in a radial direction.

The shape and the number of protruded pieces 3 and draining path portions 6 are not limited to the illustrated example, but can be set to an adequate shape and the number according to the application.

Since the non-slip pattern 4 is constituted as described above, the peripheral hem of the protruded piece 3 has the edge 7 almost vertically raised with the above-described joining cutting line as the highest position, and its shape is arranged in a flat circular arc along the outer periphery of the center portion 5 at equal intervals (at intervals of 90 degree in the case of the illustrated example) and, therefore, a non-slip effect can be enhanced.

Also, since the through hole is not formed, and the edge 7 of the protruded piece contacts at least the thickness portion of the steel plate 2, no fluids such as water and slurry or ambience such as heat and noises are allowed to move freely from the upper side to the underside or inversely from the underside to the upper side.

Moreover, even when the water is accumulated in the center portion 5 which is surrounded by the protruded pieces, it is discharged through the radially shaped draining path portions 6, and can be cleaned up conveniently.

In the above-described embodiment, though a steel plate is cited as an example, other metal plates may be used in this invention.

Also, the shape of the protruded piece and the non-slip pattern is not limited to the above-described embodiment, but may be adequately changed in design depending on the application.

Furthermore, this non-slip structure is not limited to the cover plate of the construction equipment similarly to the above-described embodiment, but may be used for various types of the floor surfaces, the treads and the like, to be brief, the treads on which the user steps, and can be, applied to all sorts of the applications similarly to the banded steel plate.

INDUSTRIAL APPLICABILITY

Since the non-slip structure as described above performs a non-slip effect by means of the edge rising high vertically, it can be improved, compared to the conventional structure, which is low in height and rounded.

Also, since there is no need to open a through hole, the trouble caused by the flow of a fluid or ambience is controlled, so that there is no limit imposed on the application. Also, there is no need to make a double structure, which superposes the structure on the flat steel plate and the like similarly to the conventional ways.

Also, since the forming of the protruded piece can simultaneously form the center portion and the draining path portion connected thereto, the operability of the cleaning can be enhanced.

What is claimed is:

1. A non-slip structure comprising a metal plate lying in a plane and having at least one raised unit, each unit comprising at least two protruding partially spherical portions having the same configuration arranged radially with respect to each other to provide a center section surrounded by said at least two protruding portions, each of said portions being formed by shearing said plate and each portion having two lateral side surfaces and an end surface facing said center section, the bottom edges of said lateral side and end surfaces being connected to said metal plate, whereby no gap or any through hole is produced between said metal plate and said bottom edges of said surfaces, said two lateral side surfaces curving upwardly from the plane of said metal plate and tapering toward each other in the direction of said end surface, said end surface extending between said lateral side surfaces at the highest point of said protruding portion so that each portion has a general fan shape as viewed from the top, each of said portions extending above said metal plate by a height which is less than the thickness of said plate to eliminate a passage through said plate, the lateral side surfaces of adjacent units forming an open drainage path of uniform width extending from said center section.

2. The non-slip structure according to claim 1 in which the center section is a horizontal surface; and each protruded portion is radially spaced from the next protruded portion in the direction of the center.

3. The non-slip structure according to claim 2, in which the space between said protruded portions is in the same plane as said center section and forms a draining path portion connected to the center section.

4. The non-slip structure according to claim 3, comprising a plurality of units, a center portion between said plurality of units having a surface lying in the plane of said metal plate, said drainage path lying in the plane of said metal plate connected to said center portion and extending between adjacent protruded portions of said plurality of units.

5. The non-slip structure according to claim 4, wherein four of the protruded portions are arranged at intervals of 90 degrees with the center section as the center.

6. A non-slip structure, wherein said plurality of units according to claim 4 are formed on a front surface of said metal plate, said metal plate being adapted to cover the frame bodies of construction equipment.

7. A non-slip structure comprising a metal plate having a top surface and at least one raised unit extending above said top surface, each unit comprising at least two protruding partially spherical portions having the same configuration and arranged circularly with respect to each other to define a central open space therebetween on said top surface of said plate which is surrounded by said at least two protruding portions, each of said portions being formed by shearing said plate and each portion having two lateral side surfaces and an exposed end surface facing said center section, the bottom edges of said lateral side and end surfaces being connected to said metal plate, whereby no gap or any through hole is produced between said metal plate and said bottom edges of said surfaces, said two lateral side surfaces curving upwardly from the top surface of said metal plate and tapering toward each other in the direction of said exposed end surface, said exposed end surface extending between said lateral side surfaces at the highest point of said protruding portion so that each portion has a general shape of a segment of a sphere as viewed from the top, each of said portions extending above said metal plate by a height which is less than the thickness of said plate, the lateral side surfaces of adjacent units lying in the same circle forming an open drainage path of uniform width extending from said central open space.

8. The non-slip structure according to claim 7, wherein four of the protruded portions are arranged at intervals of 90 degrees with the center section as the center.

9. A non-slip structure, wherein said plurality of units according to claim 7 are formed on a front surface of said metal plate, said metal plate being adapted to cover the frame bodies of construction equipment.

* * * * *